US005509337A

United States Patent [19]

Norman et al.

[11] Patent Number: 5,509,337

[45] Date of Patent: Apr. 23, 1996

[54] RING GUARD FOR FOOD SLICING MACHINE BLADE

[75] Inventors: Clyde W. Norman, Montgomery; James A. Shirk, Union Montgomery; Danny J. Mitchell, New Carlisle Clark, all of Ohio

[73] Assignee: Premark FEG Corporatin, Wilmington, Del.

[21] Appl. No.: 289,888

[22] Filed: Aug. 12, 1994

[51] Int. Cl.[6] ..... B26D 7/22

[52] U.S. Cl. ..... 83/546; 83/478; 83/DIG. 1

[58] Field of Search ..... 83/478, 546, 544, 83/860, DIG. 1

[56] References Cited

U.S. PATENT DOCUMENTS

| | | | |
|---|---|---|---|
| 1,142,901 | 6/1915 | McCormick et al. | 83/546 |
| 1,518,474 | 12/1924 | Wile . | |
| 2,513,598 | 7/1950 | Thomas | 83/546 |
| 2,563,120 | 8/1951 | Klingens et al. | 83/546 |
| 2,573,860 | 11/1951 | Meeker et al. | 146/102 |
| 2,619,142 | 11/1952 | Ditting | 146/102 |
| 2,970,624 | 2/1961 | Lundell | 146/102 |
| 4,186,634 | 2/1980 | Akezinski, Sr. | 83/478 |
| 4,246,818 | 1/1981 | McGraw, Jr. | 83/478 |
| 4,615,250 | 10/1986 | Flammann et al. | 83/478 |
| 4,962,581 | 10/1990 | Rutigliano | 29/426.1 |
| 5,101,704 | 4/1992 | Jones et al. | 83/174 |
| 5,188,011 | 2/1993 | Somal et al. | 83/478 |

FOREIGN PATENT DOCUMENTS

| | | | |
|---|---|---|---|
| 2594375 | 8/1987 | France | B26D 7/22 |

*Primary Examiner*—Kenneth E. Peterson
*Attorney, Agent, or Firm*—Thompson, Hine and Flory

[57] ABSTRACT

The invention relates to a guard which covers the periphery of the blade during use and is axially displaceable a limited distance to allow access to the rear of the blade to facilitate cleaning. The guard is mounted on the slicing machine in a fashion which prevents its removal except under condition in which the blade itself is first removed.

12 Claims, 4 Drawing Sheets

RING GUARD FOR FOOD SLICING MACHINE BLADE

This invention relates to a slicing blade ring guard for a food slicing machine.

BACKGROUND

Meat and cheese slicers having a sharpened disk blade are commonly used in restaurant and grocery businesses, among others. Because the blades of these slicers are extremely sharp, it is conventional practice in the industry to construct the slicer with a stationary blade guard which shields the portions of the blade downstream from the cutting operation to prevent the user from coming into contact with the blade during operation. Fat and food debris tends to build up on the blade and blade guard, particularly, in the space between the blade guard and the blade and on the rear of the blade. It is difficult to clean this build-up in many slicers because the blade guard cannot be removed from the slicer without substantial disassembly and with the guard in place there is only a limited space for the operator to clean the blade.

To overcome the difficulty in cleaning the blade presented by the blade guard, slicers have employed removable blade guards or temporary blade covers have been designed to cover the blade once its guard was removed. For example, U.S. Pat. No. 2,573,860 to Meeker, et al. teaches a knife guard for slicing machines. This guard is secured to the apparatus by means of pins which lock the guard in place around the blade. The guard must then be removed to clean the blade.

U.S. Pat. No. 4,962,581 to Rutigliano teaches a blade sheath for use in cleaning a meat slicer blade. The sheath is circular and has two ends connected by a bail and clip to form a ring which surrounds the edge of the blade. The sheath is open to cover the circumference of the blade edge of the slicer and then locked into position by the bail and clip.

U.S. Pat. No. 5,188,011 to Somal et al. discloses a temporary cover for the slicing knife of a slicing machine. The cover is substantially circular and includes a flange which encircles the knife edge when the cover is in place. The cover also includes a retention pin and a spring-loaded retractable plunger which removably retains the cover on the slicing knife. This cover is designed to prevent the person cleaning the slicer blade from coming into contact with the blade edge. However, the blade guard which covers the blade during use must first be removed before the temporary cover can be applied.

SUMMARY OF THE INVENTION

This invention relates generally to a food slicer of the type having a rotatable circular or disc-like slicing blade, a gauge plate along one edge of the blade for determining the thickness of slices and a carriage for supporting food product as it is moved past the cutting edge of the blade during slicing. The invention relates to a guard which covers the periphery of the blade during use and is axially displaceable a limited distance to allow access to the rear of the blade to facilitate cleaning. The guard is mounted on the slicing machine in a fashion which prevents its removal except under conditions in which the blade itself is first removed.

This invention is directed specifically to a modification of a food slicer ring guard which permits the ring guard to be moved a limited distance axially in respect to the plane of the blade to facilitate cleaning while not exposing the blade edge. The ring guard is slidably mounted by means of one or more fasteners which permit the ring guard to be lifted axially to permit cleaning. A generally circular cover plate is positioned over the ring guard and blade, except for the cutting area across which food product passes during slicing, so that it covers the face of the blade during a slicing operation. The cover plate retains the ring guard in a first position covering the edge of the blade and is easily removable from the blade ring guard to enable cleaning of the face of the blade in its entirety after a slicing operation has been performed. When in position over the blade, the cover plate prevents axial movement of the ring guard with respect to the blade. The mounting apparatus for supporting the blade ring guard consists of fasteners mounted on arms extending from a central hub, which allows a large portion of the rear side of the blade to be exposed for hand cleaning by wiping with a cloth or other cleaning instrument. For cleaning, the cover is removed and the ring guard slides axially on its securing fasteners to facilitate cleaning. The slicing machine also includes a stud which is engaged by a cam lock on the cover plate to retain the surface cover in position over the ring guard during cutting operations.

One drawback of the previously described embodiment is that the ring can wedge on the fasteners and not slide evenly on those fasteners. The second embodiment eliminates wedging by mounting the ring guard in an anti-rotation bracket. In this alternate embodiment, the ring guard is slidably mounted on one fastener and engages a second fastener by means of a cutout. In the alternate embodiment, the ring guard includes a handle which engages the anti-rotation bracket to prevent the ring guard from rotating about the single fastener. The alternate embodiment includes a hub bearing two arms, one of which includes the stud engaged by the cam lock and the other includes a dowel pin. The dowel pin extends through an aperture in the ring guard and an aperture in the cover plate to properly position and secure the cover plate onto the slicing machine.

DETAILED DESCRIPTION

Figure 1:
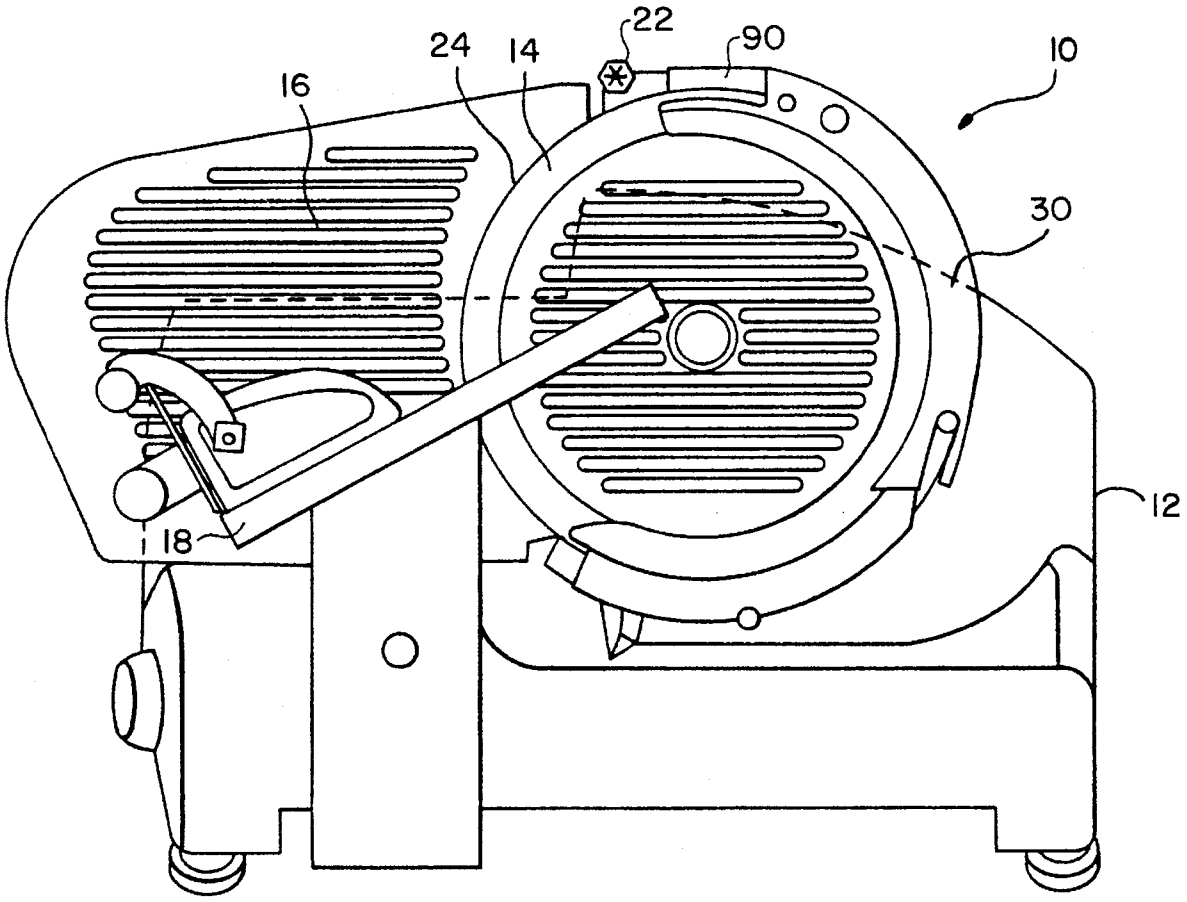
FIG. 1 is a perspective view of a slicing machine having a blade ring guard.

As seen in FIG. 1, a food slicing machine 10 includes housing 12, cutting blade 14, gauge plate 16, product supporting carriage 18, and a cover plate 30.

The circular or disc-like slicing blade 14 and slice thickness gauge plate 16 are shown in FIG. 1. They are conventional and are mounted on housing 12 of slicing machine 10. Slicing machine 10 conventionally includes product supporting carriage 18 which is reciprocated either manually by the slicing machine operator or driven by a motor in the case of an automatic slicer. Since all of these elements are old and well-known in the art, they will be described only briefly herein, it being understood that cutting blade 14 is mounted for rotation on a shaft and that gauge plate 16 is movable transversely with respect to the plane of cutting blade 14 to control slice thickness, it further being understood that blade 14 is rotated by a motor which is not shown. Gauge plate 16 can also be located in the "zero" position wherein it is slightly raised above the cutting portion of the peripheral blade edge 24. Gauge plate 16 covers approximately one-third of blade edge 24 of blade 14 during use or cleaning operations.

Figure 3A:
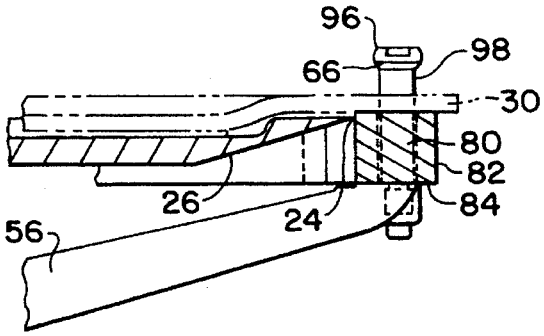
FIG. 3A is a partial cross-sectional view of the blade ring guard of FIG. 2 in the first position taken substantially along lines 3—3.
Figure 3B:
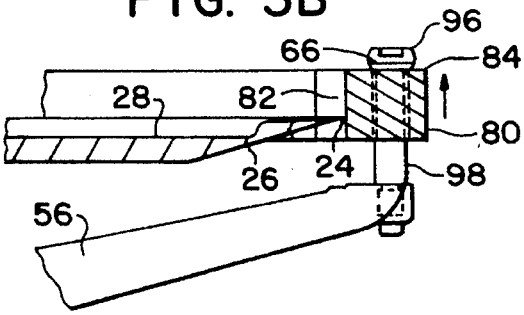
FIG. 3B is a partial cross-sectional view of the blade ring guard of FIG. 2 in the second position taken substantially along line 3—3.

Preferably, ring guard 80 has a rectangular cross section as shown in FIGS. 3A and 3B. Although ring guard 80 has a rectangular cross section in the preferred embodiment, one skilled in the art can appreciate that ring guard 80 can have any desired cross section. For example, in an alternate embodiment of this invention, ring guard 80 may have a square or L-shaped cross section. The only requirement for the cross section of ring guard 80 is that ring guard 80 can be moved axially in respect to the blade and still provide coverage of the blade edge 24 when in the raised position.

Ring guard 80 may also include a handle (not shown) mounted thereon or finger grips (not shown) machined therein to facilitate moving it so that rear surface 26 of cutting blade 14 can be cleaned. Ring guard 80 may also include a bridged opening 90 along its upper edge to expose a portion of the blade edge 24 for sharpening. For example, a sharpener such as that described in U.S. Pat. No. 5,101,704 to Jones et al. is useful with this invention.

Ring guard 80 may be formed of flat metal stock or it may be cast. Any suitable metal, such as aluminum or stainless steel, may be employed to construct ring guard 80, with aluminum being preferred. The ability to cast ring guard 80 allows it to be more economically manufactured than if machined from flat or solid stock.

Arms 52–56 may be mounted on the housing in any convenient manner. In one embodiment, the arms are mounted in slots (not shown) provided radially of the bearing block (not shown) on hub 42 for shaft (not shown) of a motor (not shown) mounted within housing 12. Arm 58 is part of the casting of hub 42. The shaft (not shown) which drives the cutting blade 14 includes a nut or other fastener for mounting cutting blade 14 onto the shaft. The shaft is mounted in bearings in hub 42. Design and construction is such that blade 14 and hub 42 must be removed from the housing 12 in order to enable the ring guard 80 to be removed from the machine 10. Arms 52–56 may also be formed integrally with hub 42 or connected by pins preferably requiring that the pins cannot be removed to allow arms 52–58 to be removed from hub 42 unless blade 14 and hub 42 are first removed from housing 12. Hub 42 is fastened to housing 12 by means of screws (not shown) passing through holes 48. The ring guard 80 and arms 52–58 provide an interconnected unit which is preferably constructed such that it must be mounted onto machine 10 during assembly or repair prior to installation of cutting blade 14 and can not be removed from machine 10 unless cutting blade 14 has been removed.

Figure 2:
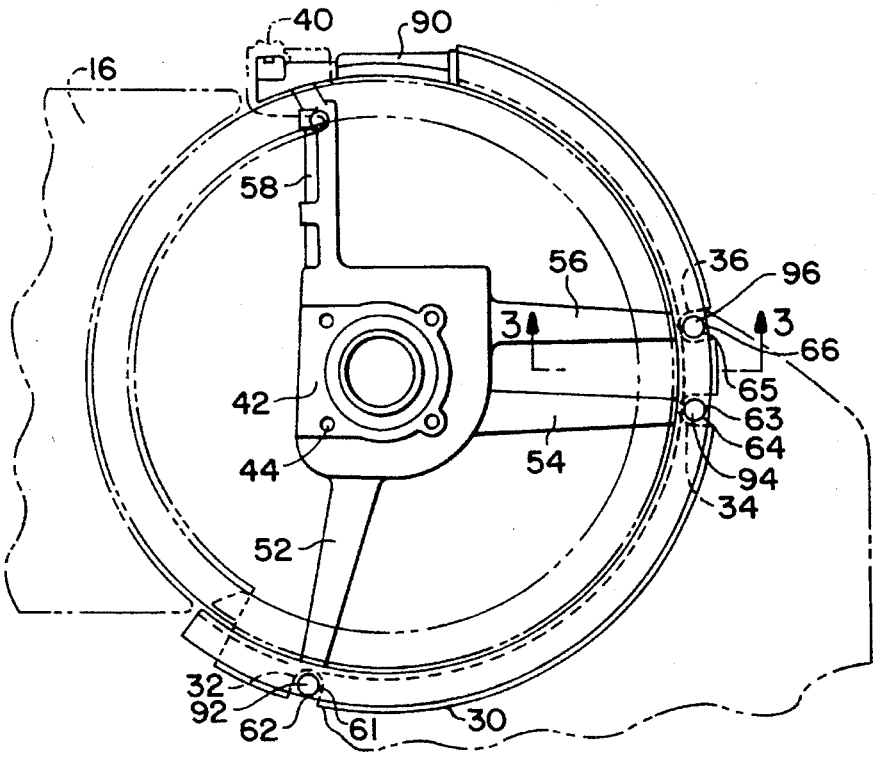
FIG. 2 is a perspective view of the blade ring guard and its supporting arms and hub.

As seen in FIG. 2, arms 52–58 support ring guard 80 and are preferably arranged so that a large portion of the underside or rear 26 of blade 14 is accessible for cleaning. The outer ends of arms 52, 54 and 56 have fasteners 62, 64 and 66, respectively, secured thereto. Each fastener 62, 64 and 66 has a flat head portion 92, 94 and 96, respectively, and a shaft portion 98, as seen in FIG. 3A. Shafts 98 are smooth to facilitate axial movement of ring guard 80. In this embodiment, the height of the fastener above the arms is slightly less than twice the height of the ring guard cross section.

As seen in FIGS. 3A and 3B, ring guard 80 is positioned around edge 24 of cutting blade 14 such that it covers that portion of cutting blade 14 which is not covered by gauge plate 16 and not used for slicing. Ring guard 80 typically covers approximately 240° of peripheral edge 24. Ring guard 80 is attached Such that side 84 of its rectangular cross section extends parallel to cutting blade 14 and side 82 of the cross section extends perpendicular to blade edge 24 of cutting blade 14 a distance sufficient to limit the user's contact with the blade edge 24 even when the ring guard is axially extended. Ring guard 80 is preferably positioned no more than 1 mm from edge 24 of blade 14. In the "home" position, i.e., during cutting, as seen in FIG. 3, side 82 limits the user's access to the rear surface 26 of cutting blade 14. One should note that when ring guard 80 is in the home position, the user may have difficulty cleaning rear side 26 of cutting blade 14 adjacent edge 24 because of the interference provided by ring guard 80. In the home position, side 82 of ring guard 80 extends below blade edge 24.

Ring guard 80 is slidably mounted on assembly 50 on fasteners 62, 64 and 66. Ring guard 80 has apertures 61, 63 and 65 therethrough to accommodate fasteners 62–66, respectively. Ring guard 80 is mounted such that when the cover is removed it can move axially on fasteners 62–66 in respect to the surface 28 of cutting blade 14. To facilitate its axial movement, ring guard 80 may include a handle (not shown) or a finger grip machined or cast therein (also not shown).

When slicing machine 10 is in operation, ring guard 80 is secured in the home position by cover plate 30 which is removably mounted on fasteners 62, 64 and 66 between the heads of the fasteners and the ring guard. Cover plate 30 has cutouts 32, 34 and 36 which receive fasteners 62, 64 and 66, respectively, therein. The head portions 92–96 of fasteners 62–66 extend above the exposed surface of ring guard 80 establishing a space to receive cover plate 30 at cutouts 32–36. The leading edge of cover plate 30 is adjacent surface 26 of blade 14 so that the food passes across surface 26 and is supported by cover plate 30.

Figure 4:
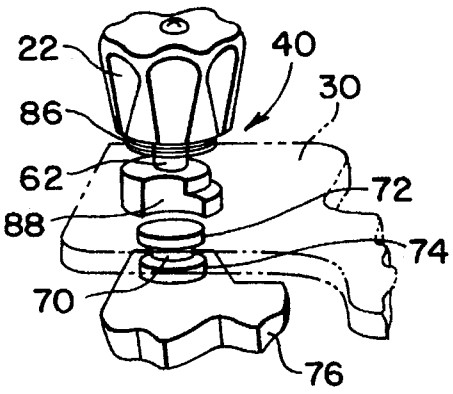
FIG. 4 is a detail view of the locking apparatus which secures the cover plate in position over the cutting blade.

As shown in FIG. 4, locking stud 70 is secured to the end of flange 76 which extends from arm 58. Locking stud 70 has a head 72 and a base 74. Cam lock 40, which is mounted on cover plate 30, engages locking stud 70 to secure cover plate 30 over cutting blade 14. Cam lock 40 has a cam 60, which is eccentrically mounted on shaft 62 of the cam lock 40 adjacent locking stud 70. Cam 60 is generally circular and includes a semicircular cutout 88 thereon. Cam lock 40 may also include a torsion spring 86 and, to facilitate rotation of cam 60, handle 22 is provided. Those skilled in the art will appreciate that cam lock 40 can be provided on the bracket or at numerous locations other than on the cover plate.

To engage stud 70, cam lock 40 is rotated by handle 22 so that the cutout position 88 comes into alignment with head 72 of stud 70. Handle 22 is then released and torsion spring 86 rotates cam 60 of cam lock 40 so that cam 60 slides between head 72 and base 74 of stud 70. Because cam 60 is eccentrically mounted, it applies a force which acts to seat cutouts 32–36 onto fasteners 62–66 as it is rotated into position between head 72 and base 74 of locking stud 70.

To remove cover plate 30, cam lock 40 must first be disengaged from locking stud 70. To disengage cam lock 40 from locking stud 70, cam lock 40 is rotated by handle 22 until cutout 88 is aligned with head 72 of locking stud 70. Cam lock 40 can then be removed from engagement with locking stud 70 by lifting cover plate 30 upwardly. Once cam lock 40 is disengaged from locking stud 70, cover plate 30 may then be removed from the slicing machine 10 by lifting it upwardly and slightly diagonally so that cutouts 32–36 disengage from fasteners 62–66.

Reinstallation of cover plate 30 is achieved in the reverse order, cover plate 30 is placed onto slicing machine 10 so that cutouts 32–36 engage their respective fasteners 62–66. Cam lock 4.0 is then moved to engage locking stud 70, as described above. Once secured, cover plate 30 is secured at four points, fasteners 62–66 and locking stud 70, to provide sufficient stability to support the weight of the product being sliced and to secure ring guard 80 in position covering edge 24 of cutting blade 14.

For cleaning, ring guard 80 can be moved a limited distance axially in respect to surface 28 of cutting blade 14 and, due to the length of side 82, this movement will not expose edge 24 of blade 14. To do this, cover plate 30 is removed by loosening cam lock 40 on stud 70 and lifting cover plate 30 from surface 28 of cutting blade 14, as described above. Once cover plate 30 has been removed, ring guard 80 can be lifted axially by sliding it on fasteners 62–66 to a raised position, as seen in FIG. 3B. The axial movement of ring guard 80 is limited by head portions 92, 94 and 96 of fasteners 62–66. The distance that ring guard 80 can be moved is approximately equal to the height of ring guard 80. Heads 92–96 of fasteners 62–66 prevent the user from removing ring guard 80 from the food slicing machine 10 during the cleaning operation. When in the raised position, side 82 of ring guard 80 provides coverage of edge 24 of cutting blade 14 as seen in FIG. 3B. The user then has access to rear surface 26 of cutting blade 14 for cleaning but is hindered from coming into contact with blade edge 24. To clean rear surface 26 of cutting blade 14, the user manually rotates cutting blade 14 wiping it with a cloth or other similar object to remove accumulated food debris from rear surface 26 of cutting blade 14.

After cleaning has been completed, the user moves ring guard 80 axially toward surface 28 of cutting blade 14. Cover plate 30 can then repositioned onto slicer 10, as described above. Once cover plate 30 is in position, cam lock 40 secures cover plate 30 and ring guard 80 in the home position so that cutting operations may begin.

As the radial distance between fasteners 64 and 66 increases, ring guard 80 may not slide evenly on fasteners 64 and 66, i.e., one end of ring guard 80 may raise up before the second end, thus causing ring guard 80 to become wedged on one or all of fasteners. To prevent ring guard 80 from binding as it is moved axially, it has been found that when at least two fasteners are used, the optimal sliding action results if two adjacent fasteners, such as fasteners 64 and 66, are separated radially by no more than approximately 90°.

Figure 5:
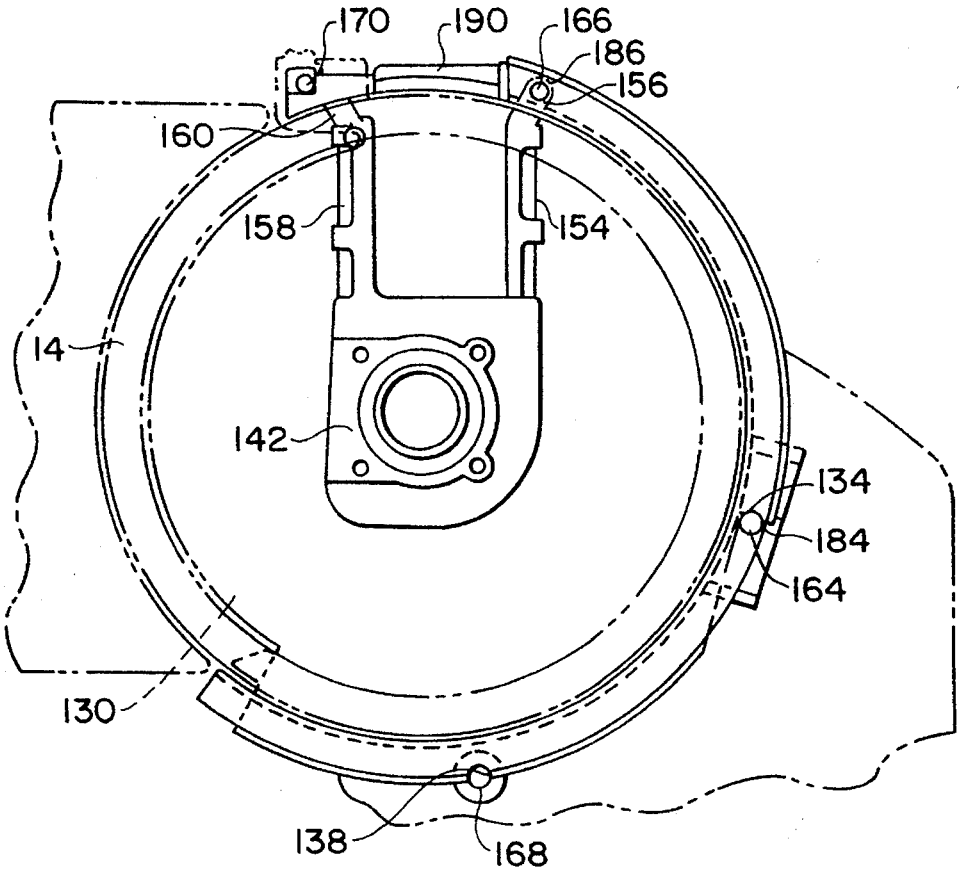
FIG. 5 is a perspective view of an alternate embodiment of the ring guard of this invention.

FIG. 5 presents a perspective view of an alternate embodiment of the invention. Hub 142 has two arms, 154 and 158, extending therefrom. Dowel pin 166 is mounted on flange 156 which extends from arm 154. Locking stud 170 is mounted on flange 160 which extends from arm 158. Bridge 190 extends between arms 154 and 158. Bridge 190 exposes a portion of blade 14 so that it can be accessed for sharpening. This may be accomplished by a sharpener (not shown) which can be mounted on the slicing machine 10 so that it accesses the blade 14 in the space created by bridge 190. As stated previously, U.S. Pat. No. 5,101,704 to Jones et al. describes a moveable sharpener useful with this invention.

Figure 6:
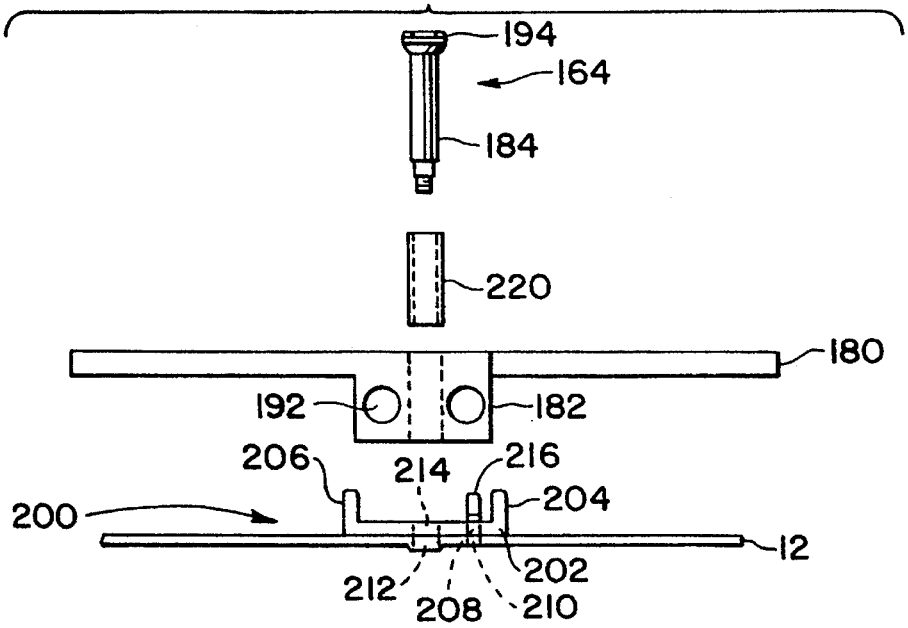
FIG. 6 is a view of the ring guard rest for the alternate embodiment of this invention.
Figure 7:
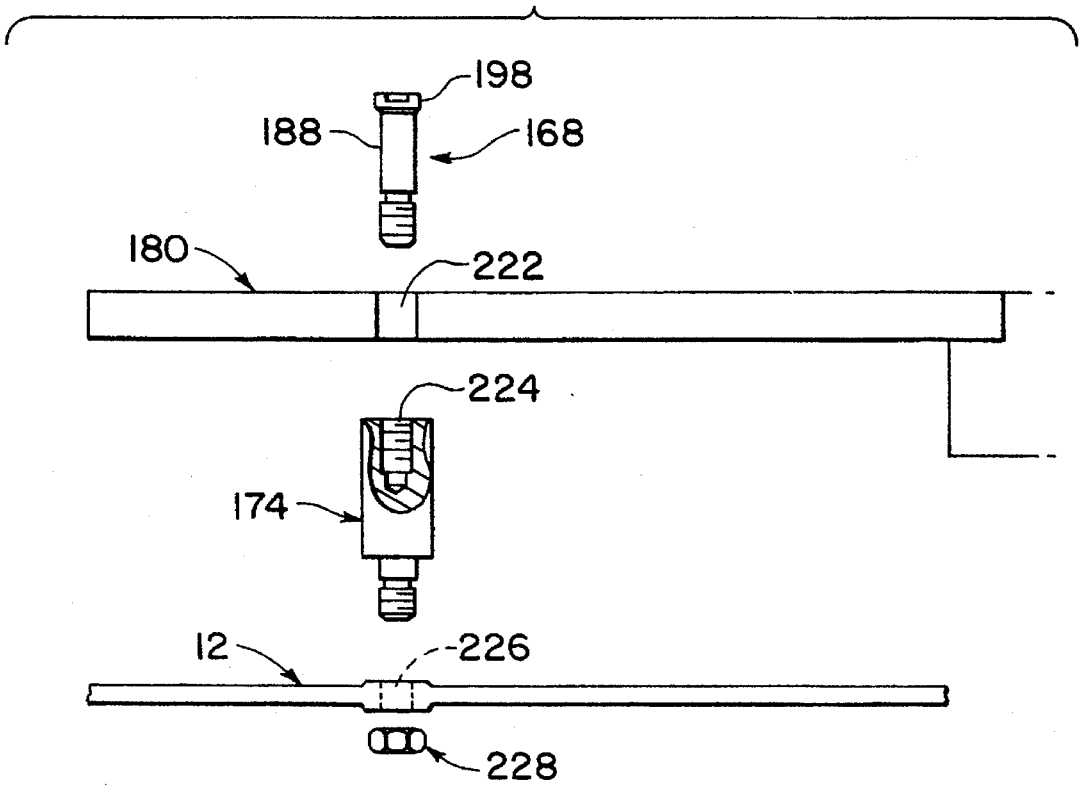
FIG. 7 is a view Of the anti-rotation casting for the alternate embodiment of this invention.

Headed fasteners 164 and 168 are mounted directly on housing 12. As seen in FIG. 6, headed fastener 164 is threadedly mounted in aperture 212 in base 12. Headed fastener 164 has a smooth shaft 184 and a head 194. As seen in FIG. 7, fastener 168 is threadedly mounted in threaded slot 224 in ring guard rest 174. Ring guard rest 174 is then threaded into aperture 226 in housing 12 and secured by nut 228. Headed fastener 168 has a shaft 188 and a head 198.

In this alternate embodiment, ring guard 180 is slidably mounted on headed fastener 164, as shown in FIG. 6. Ring guard 180 has apertures 184 and 186 therethrough to accommodate headed fastener 164 and dowel pin 166, respectively. Dowel pin 166 extends through aperture 186 in ring guard 80 and a corresponding aperture in cover 130 and thereby acts to position cover plate 130 onto the surface of slicing blade 14 and ring guard 180. Ring guard 180 is mounted such that it can move axially on headed fastener 164 in respect to the surface of cutting blade 14. Ring guard further includes a partial cutout 222 which receives fastener 168. Ring guard 180 also includes a block 182. Block 182 includes sleeve 220 which is pressed therein to facilitate movement of ring guard 180 on headed fastener 164. Block 182 may optionally include a finger grip 192 machined therein.

In this alternate embodiment, cover plate 130 has two cutouts, 134 and 138, which engage fasteners 164 and 168, respectively, beneath their head portions 194 and 198 along their respective shaft portions 184 and 188. Cover plate 130 also has an aperture which slidably receives dowel pin 166. Cover plate 130 is fitted onto the face of the slicing machine 10 by aligning cutouts 134 and 138 with fasteners 164 and 168. Once the cutouts, 134 and 138, are fitted onto their respective fasteners, 164 and 168, aperture is fitted over dowel pin 166. Dowel pin 166 acts to seat cutouts 134 and 138 onto fasteners 164 and 168 and to provide for proper alignment of cover plate 130 as the food product is passed over it over slicing blade 14. Dowel pin 166 also acts to prevent translational motion of cover plate 130 during a slicing operation. Cover plate 130 is then locked into place by the same cam lock mechanism (shown in phantom), as described above. In this embodiment, when in the locked positions, cover plate 130 is also secured at four positions, i.e. at fasteners 164 and 168, pin 166 and locking stud 170, to support the product being sliced.

To prevent ring guard 180 from rotating about fastener 164, this embodiment includes an anti-rotation bracket 200, as shown in FIG. 6. Anti-rotation bracket 200 is mounted on the housing 12 of slicing machine 10. Anti-rotation bracket 200 has a base 202 and two arms 204 and 206. Base 202 has two slots therein, threaded slot 214 and slot 208. Fastener 164 threadedly secures base 202 of anti-rotation bracket 200 to housing 12 by threading through slot 214 and slot 212 in base 12. Pin 216 mounts in slot 208 and slot 210 in base 12 to prevent rotational movement of anti-rotation bracket 200 about fastener 164. Block 182 which is integral with ring guard 180 sits in the bracket formed by arms 204 and 206. Arms 204 and 206 extend upwardly a distance which is slightly longer than the distance covered when ring guard 180 is moved axially. Thus, arms 204 and 206 prevent ring guard 180 from rotating about fastener 164 as ring guard 180 is moved upwardly by providing a guide for the axial movement of block 182.

Block 182 and rest 174 space ring guard 180 from housing 12. Block 182, because it is integral with ring guard 180 and extends below ring guard 180, provides the lower motional limit for ring guard 180 on fastener 164. The upper-limit for the axial motion of ring guard 180 on fastener 164 is provided by head 194. On pin 168, the axial movement of ring guard 180 is restricted on the low side by ring guard rest 174 into which fastener 168 is mounted and on the high side by head 198 of fastener 168. To provide proper spacing of ring guard 180 from housing 12, block 182 and ring guard rest 174 have approximately the same height.

Having described the invention in detail and by reference to the described embodiments thereof, it will be apparent that modifications and variations are possible without departing from the scope of the invention defined in the appended claims.

What is claimed is:

1. A food product slicing machine comprising:

a housing;

a circular slicing blade having a peripheral cutting edge, the blade being rotatably mounted on the housing;

a bracket extending from the housing;

a plurality of fasteners mounted on the bracket;

a ring guard surrounding the peripheral cutting edge of the blade, the ring guard having at least one aperture through which at least one of the fasteners extends; and a generally circular cover plate is removably mounted on the fasteners;

wherein, the ring guard is maintained in a first position when the cover plate is mounted on the ring guard, and the ring guard is axially displaceable to a second position when the cover plate removed, the ring guard surrounding the peripheral cutting edge of the cutting blade in both the first and second positions.

2. The food product slicing machine of claim 1 wherein at least one of the fasteners has a head portion and a shaft portion; the fastener extends from a surface of the ring guard to provide a space on the fastener; and the cover plate includes at least one slot which engages the shaft portion in the space.

3. The food product slicing machine of claim 2 further comprising a cam lock which secures the ring guard.

4. The food product slicing machine of claim 2 wherein one of the fasteners is a pin and the cover plate includes an aperture which is engaged by the pin to facilitate positioning and securing of the cover plate on the slicing machine.

5. The food product slicing machine of claim 4 further comprising an anti-rotation bracket mounted on the housing.

6. The food product slicing machine of claim 5 wherein the ring guard includes a block which engages the anti-rotation bracket to prevent rotation of the ring guard about the fastener.

7. The food product slicing machine of claim 6 wherein the cam lock includes an eccentric head cam and is mounted on the cover plate such that, when the cam lock engages a locking stud on the ring guard the cover plate is held in position on the ring guard.

8. The food product slicing machine of claim 2 wherein a plurality of the fasteners have a head portion and a shaft portion; the fasteners extend from the surface of the ring guard to provide spaces on the fasteners; and the cover plate includes a plurality of slots which engage the shaft portions in the corresponding spaces.

9. The food product slicing machine of claim 8 further comprising a cam lock which secures the ring guard.

10. The food slicing machine of claim 1 wherein the ring guard can only be removed from the slicing machine after first removing the cutting blade.

11. The food product slicing machine of claim 10 wherein the cam lock includes an eccentric head cam and is mounted on the cover plate such that, when the cam lock engages a locking stud on the ring guard the cover plate is held in position on the ring guard.

12. The food product slicing machine of claim 1 wherein the ring guard has a handle mounted thereon to facilitate axial movement of the ring guard.

* * * * *

UNITED STATES PATENT AND TRADEMARK OFFICE

CERTIFICATE OF CORRECTION

PATENT NO. : 5,509,337
DATED : April 23, 1996
INVENTOR(S) : Clyde W. Norman et al.

It is certified that error appears in the above-indentified patent and that said Letters Patent is hereby corrected as shown below:

Col. 7, line 31 (claim 1), remove the word "is".

Col. 7, line 36 (claim 1), after the word "plate" add -- is --.

Signed and Sealed this

Twenty-third Day of July, 1996

*Attest:*

Bruce Lehman

BRUCE LEHMAN

*Attesting Officer*

*Commissioner of Patents and Trademarks*